United States Patent [19]

Habu et al.

[11] 4,242,444

[45] Dec. 30, 1980

[54] PROCESS FOR THE PREPARATION OF LIGHT-SENSITIVE SILVER HALIDE PHOTOGRAPHIC MATERIAL

[75] Inventors: Teiji Habu; Masao Ishihara; Sadatugu Terada; Eiichi Sakamoto; Hiroshi Yamada, all of Hino, Japan

[73] Assignee: Konishiroku Photo Industry Co., Ltd., Tokyo, Japan

[21] Appl. No.: 921,102

[22] Filed: Jun. 30, 1978

[30] Foreign Application Priority Data

Jul. 4, 1977 [JP] Japan ..... 52-79647

[51] Int. Cl.[3] ..... G03C 1/78; G03C 1/02; G03C 1/38

[52] U.S. Cl. ..... 430/510; 430/527; 430/529; 430/546; 430/631; 430/635; 430/636; 430/637; 430/954; 430/960

[58] Field of Search ..... 96/87 R, 67, 114.2, 96/114.5; 428/412, 421; 430/631, 935, 510, 527, 529, 961, 635, 636, 637, 954, 546

[56] References Cited

U.S. PATENT DOCUMENTS

| | | | |
|---|---|---|---|
| Re. 29,255 | 6/1977 | McDowell | 96/87 R |
| B 501,379 | 3/1976 | Babbitt et al. | 428/412 |
| 3,666,478 | 5/1972 | Groh et al. | 96/114.5 |
| 3,754,924 | 8/1973 | De Geest et al. | 96/114.2 |
| 3,775,126 | 11/1973 | Babbitt et al. | 96/67 |
| 3,850,640 | 11/1974 | Babbitt et al. | 96/67 |
| 3,929,485 | 12/1975 | Miyakawa et al. | 96/66 R |
| 3,948,663 | 4/1976 | Shiba et al. | 96/67 |
| 4,013,696 | 3/1977 | Babbitt et al. | 428/412 |
| 4,050,940 | 9/1977 | Habu et al. | 96/114.5 |

FOREIGN PATENT DOCUMENTS 1130822 12/1966 United Kingdom .

*Primary Examiner*—Edward C. Kimlin
*Attorney, Agent, or Firm*—Bierman & Bierman

[57] ABSTRACT

A process for the preparation of a silver halide photographic material is disclosed which provides for the formation of a photographic layer by the use of a coating solution containing a compound represented by formula I or II.

$$C_{3n}F_{(6n)-1}-Y-A-B \quad (I)$$

$$C_{3n}F_{(6n)-1}-Y-A-X-A-Y-C_{3n}F_{(6n)-1} \quad (II)$$

wherein A represents a simple bond or a divalent group; Y represents oxygen or sulfur, or $$-\underset{\underset{R_1}{|}}{N}-A'-;$$

B represents a monovalent hydrophilic group; X represents a divalent hydrophilic group; n represents an integer of 1 to 4; $R_1$ represents hydrogen, a lower alkyl group; and A' represents a simple bond or an alkylene group.

12 Claims, No Drawings

PROCESS FOR THE PREPARATION OF LIGHT-SENSITIVE SILVER HALIDE PHOTOGRAPHIC MATERIAL

This invention relates to a process for the preparation of a silver halide light sensitive photographic material (referred to hereinafter as a light-sensitive material), particularly to such process that makes good coating and homogeneous film coating possible in the production of layers of a light-sensitive material by means of application of various photographic coating liquids.

As well known, a light-sensitive material comprises a subbing layer, a light-sensitive emulsion layer, a protective layer, a filter layer, an anti-halation layer and an inter layer coated on a various support such as glass plate, baryta paper, polyethylene-laminated paper, nitrocellulose, cellulose acetate, polyester, polycarbonate, etc. The above layers are coated on a support, in general, by means of a coating apparatus according to a dipping process, a double-roll process or a slide-hopper process and thereafter dried. In this case, it is of importance that the various photographic coating liquids are coated on the whole of the support at an even thickness.

As compared with the case where a photographic coating liquid is coated directly on a support without intervening layers, a number of disadvantages are liable to occur on coating due to considerable variation in the state or condition of the surface, when a certain kind of coating layer has been applied and dried on a support, when a further layer is to be coated subsequently on a coated layer which has already been cooled and set or when a liquid-liquid superpose process is to be applied. Thus, it is of great importance for achieving uniform film coating that the coating liquid has even wettability or expansibility. However, the coating step is disadvantageous because of the formation of an uneven coat both parallel and vertical to the coating direction. Additionally, incomplete coating (comets) is caused by impurities which exist in the coating surface. Such impurities include dust, insoluble substances, aggregates, oleophilic substances, etc. Finally, uneven coating (called gathering or scattering) can result when a coating liquid is gathered and thickened or scattered and diluted in the area where coating liquid is applied.

In order to prevent the above unevenness of the coated layer, there has been used, in general, a coating aid such as saponin to reduce the surface tension of a coating liquid.

However, because saponin is a natural material, the quality is not always constant and, in fact, it cannot be avoided that a great variation in the quality of saponin is caused in each batch. Further, even when saponin of the same quality was used, there was found such drawback that a great variation is caused in each batch in the photographic characteristics and the coating aid characteristics.

In place of saponin showing such a great variation in the characteristics as the coating aid, there have been used various synthetic surfactants. However, various synthetic surfactants which have been known show deterioration in the preservation properties under the photographic conditions, i.e. under a high temperature and high humidity condition. Further, on the coating at a high speed, their coating ability is not satisfactory and furthermore they are useful only for a particular photographic coating liquid or only under a particular coating condition and thus poor in wide usability. As mentioned above, it is the current status that there are only very few synthetic surfactants that are satisfactory for the above purpose.

The object of this invention is to provide a process for the preparation of a light-sensitive material which produces a homogeneous suspension and forms even coating film without causing any drawbacks such as unevenness, repellencies, comets, gathering etc., when various photographic coating liquids in which various photographic binders including gelatin and other substances are or, optionally, are not contained are to be coated at a high speed in the form of a thin film.

Another object of this invention is to provide a coating aid which is able to impart good wettability and expansibility to a coating liquid, when various photographic coating liquids are to be applied, in particular, according to the simultaneous multi-layer coating process.

Still another object of this invention is to provide a process for the preparation of a light-sensitive material having good wettability against a photographic processing solution and particularly being able to achieve stabilized photographic processing characteristics causing no formation of foam and unevenness even when development is carried out at a high speed and automatically.

The inventors have found that the above objects can be achieved when, in the preparation of the light-sensitive material, at least one of the compounds of the following general formulae [I] and [II] (referred to hereinafter as the compounds of this invention) is added as the coating aid to various photographic coating liquids:

General formula [I]

$$C_{3n}F_{6n-1}-Y-A-B$$

General formula [II]

$$C_{3n}F_{6n-1}-Y-A-X-A-Y-C_{3n}F_{6n-1}$$

wherein A represents a simple bond or a divalent group; Y represents, oxygen, sulfur or a group $$-\underset{\underset{R_1}{|}}{N}-A'-$$

in which $R_1$ represents hydrogen or a lower alkyl group and A' represents a simple bond or an alkylene group; B represents a monovalent hydrophilic group; X represents a divalent hydrophilic group; and n represents an integer of 1 to 4.

In the above general formulae [I] and [II], the divalent group for A can be any one so far as it can combine the group $C_{3n}F_{(6n)-1}-Y-$ and the hydrophilic group.

In the present invention, as preferable group for A is included a simple bond, an alkylene group (including straight or branched one and particularly preferably an alkylene group having 1 to 6 carbon atoms), a phenylene group, an aralkylene group (for example,

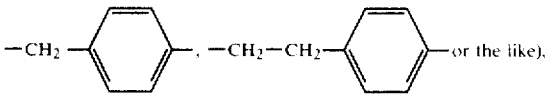

or the like), or an alkarylene group (for example,

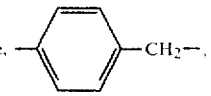

).

-continued

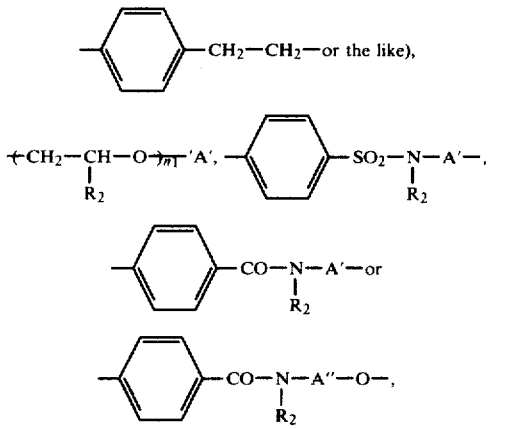

in which $R_2$ has the same meaning as $R_1$, A' represents a simple bond or an alkylene group (particularly an alkylene group having 1 to 6 carbon atoms), A'' represents an alkylene group (particularly an alkylene group having 1 to 6 carbon atoms) and $n_1$ represents an integer of 1 to 30.

The hydrophilic group for B and X may be any one that can easily be combined with a water molecule. In a preferable monovalent hydrophilic group for B are included

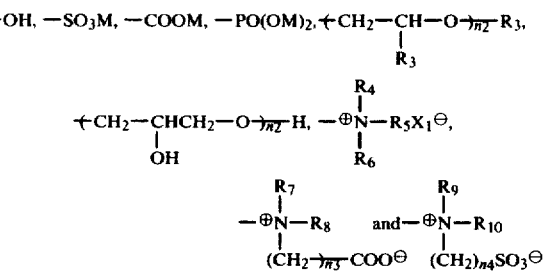

in which $R_3$ has the same meaning as $R_1$, $n_2$ has the same meaning as $n_1$, M represents hydrogen, alkali metal, substituted or unsubstituted ammonium (as a substituent, an alkyl group, in particular an alkyl group having 1 to 4 carbon atoms being preferable), $R_4$, $R_5$, $R_6$, $R_7$, $R_8$, $R_9$ and $R_{10}$ each represent an alkyl group having 1 to 6 carbon atoms, an aryl group or an aralkyl group, $n_3$ represents an integer of 1 or 2, $n_4$ represents an integer of 2 to 4 and $X_1^{\ominus}$ represents an anion. Further, $R_4$, $R_5$ and/or $R_6$, $R_7$ and $R_8$, or $R_9$ and $R_{10}$ may be cyclized together to form a 5- or 6-membered heterocyclic ring containing nitrogen.

In a preferable $X_1^{\ominus}$, halogen ion (for example, a chlorine ion, a bromine ion or an iodine ion), an alkyl sulfonate ion (for example, a lower alkyl sulfonate ion such as a methyl sulfonate ion or an ethyl sulfonate ion), an aryl sulfonate ion (for example, a phenyl sulfonate ion or a toluene sulfonate ion), a nitrate ion, a sulfonate ion, a sulfate ion and a phosphate ion are included.

In a preferable divalent hydrophilic group for X are included

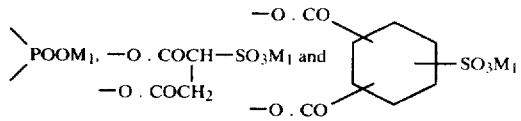

in which $M_1$ has the same meaning as M.

In a preferable 5- or 6-membered nitrogen-containing heterocyclic ring are included a pyridine ring, a pyrimidine ring, a pyridazine ring, an imidazol ring, a piperazine ring, a morpholin ring and a piperidine ring. In a 5- or 6-membered nitrogen-containing heterocyclic ring formed by the cyclization between $R_3$, $R_4$ and $R_5$, a pyridine ring is particularly preferable and a piperazine ring or a morpholine ring is particularly preferable as a 5- or 6-membered nitrogen-containing heterocyclic ring formed by the cyclization between $R_3$, $R_4$ and $R_5$, $R_6$ and $R_7$, or $R_8$ and $R_9$. Further, the lower alkyl group contained in the general formula [I] or [II] is preferably an alkyl group having 1 to 4 carbon atoms (for example, a methyl group, an ethyl group, a propyl group, an iso-propyl group, a butyl group, an iso-butyl group, a sec.-butyl group or a tert.-butyl group).

The compounds of this invention can be converted into a fluorine-containing surface active agent having a perfluoro-alkenyl group via a hexafluoropropene oligomer having a double bond, which is obtained by the oligomerization of hexafluoropropene ($CF_3CF=CF_2$) in the presence of a fluoride ion through the reaction with various nucleophilic reagents. Synthesis of the compounds of this invention has been described in Chemical Abstract, 78, 57656 h. Chemical Abstract, 80, 145042 b, Chemical Abstract, 83, 27446 a and British Pat. No. 1,130,822.

The compounds of this invention exhibit good surface activity and give no adverse effect on the photographic emulsion at all.

Further, the compounds of this invention cause quite no variation in the quality as seen for saponin but reduce the surface tension after the coating even when they are used in a small amount. What is more, because the compounds of this invention exhibit no inclination to increase viscosity, coating at a high speed such as more than 40 m per minute or superposing with even a coating solution which contains a small amount of a binder such as gelatin or as well as coating at a normal speed is practicable without causing any unevenness or comets to form very even coating film. Thus, the compounds of this invention are characterized by imparting always stable coating features.

The compounds of this invention are considered to be attainable peculiar effects which have been unable to be attained, by virtue of the fact that the compounds of this invention are highly branched and contain a double bond whereby including a number of isomers, whereas each of the fluorinated alkyl group of fluorine series surfactants which have heretofore been used widely is straight chain and saturated.

The compounds of this invention not only made the coating features good but also have advantages that they impart a static power to the light-sensitive material, when they are included particularly in a protective layer, subbing layer, supercoat layer, etc. and can inhibit the formation of a static mark.

Further, because the compounds of this invention have good surface activating ability due to the introduction of a fluorine atom of highly branched type, as compared with prior known fluorine containing surfactants, they can be applied to a multi-layer laminate wherein multiple layers are formed on the same substrate according to the wet-on-dry process or wet-on-wet process in some layers simultaneously on separately.

Furthermore, the compounds of this invention have good wettability and therefore foaming of the coating solution is not caused.

When the light-sensitive material prepared according to this invention is subjected to the contact with a processing solution in the photographic processing of the light-sensitive material, desirable effects that no foam is formed can be attained. Further, when the compounds of this invention are applied to a light-sensitive material for use in color photography, not only improvement in the coating features but also stabilization of a color developed dye image can be achieved. This is a great characteristics of the compounds of this invention.

A light-sensitive material for use in color photography containing a coupler often causes discoloration or fading, when after exposure, a dye image obtained by color development is preserved and thus outstanding deterioration of image is caused. Such phenomenon is generally considered to be due to the fact that the color developed image or undeveloped coupler which is still retained and contained is decomposed or modified during storage by means of light, heat or humidity to form a different type of decomposition product. Against the above phenomenon, various proposals have been given as a process for the prevention. However, the current status is that there has not been found any process satisfactory to be actually used.

According to the light-sensitive material for use in color photography in which the compounds of this invention have been added, such effect is achievable as prevention and inhibition of discoloration or fading of color developed image, which is caused after color development under severe conditions.

With regard to the compounds of this invention, representative exemplifications will be shown below. However, it should be noted that these exemplifications are made by way of illustration only and this invention is not limited thereto.

Exemplified Compounds:

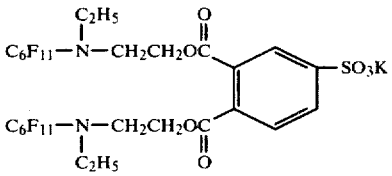
(1)

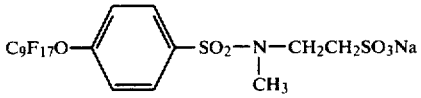
(2)

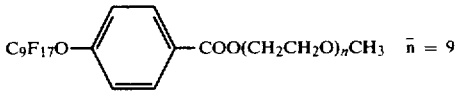
(3)

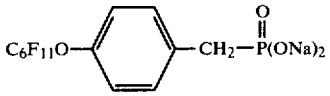
(4)

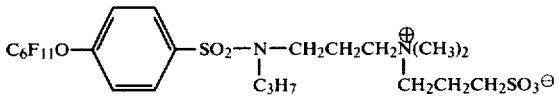
(5)

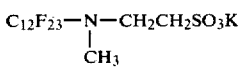
(6)

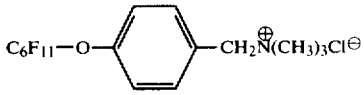
(7)

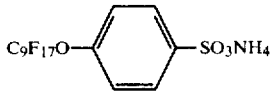
(8)

$C_9F_{17}O(CH_2CH_2O)_nCH_3$ $\bar{n} = 9$ (9)

(10)

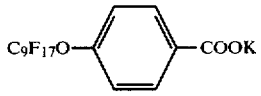

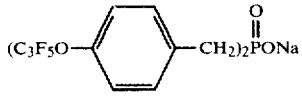
(11)

-continued
(12)
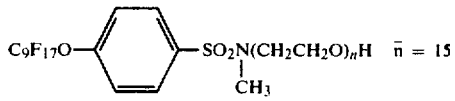
$\bar{n} = 15$
$C_{12}F_{23}O(CH_2CH_2O)_nCH_2CH_2\overset{\oplus}{N}(CH_3)_3I^{\ominus}$ $\bar{n} = 5$ (13)
(14)
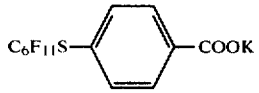
(15)
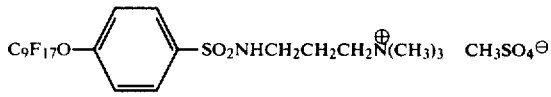
(16)
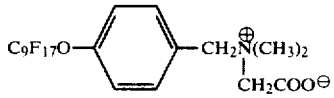
(17)
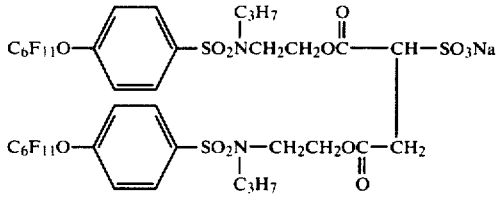
(18)
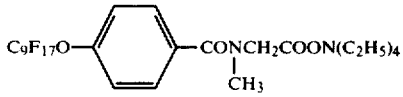
(19)
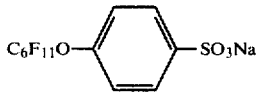
(20)
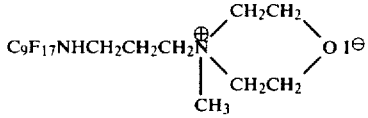
(21)
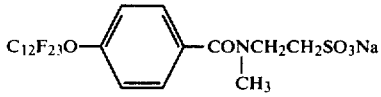
(22)
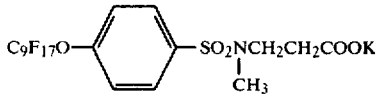
$C_9F_{17}OCH_2CH_2CH_2\overset{\oplus}{N}(CH_3)_3\ I^{\ominus}$ (23)
(24)
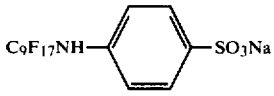
(25)
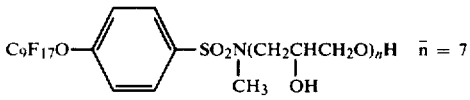
$\bar{n} = 7$
(26)
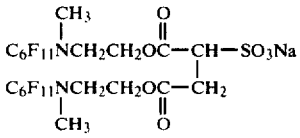
(27)
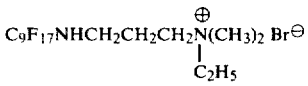

-continued (28)

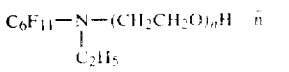

(29)

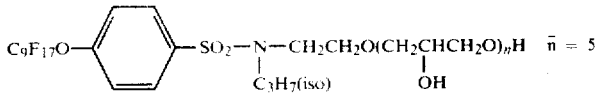

(30)

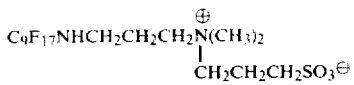

(31)

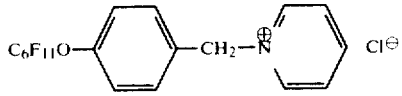

The compounds of this invention may be added to the photographic coating liquids in the form of a solution in water or in an organic solvent which is miscible with water in any proportion, such as methanol, ethanol, acetone, etc. In the case of a photographic coating liquid containing an ordinary hydrophilic colloid, the amount of the compounds of this invention to be added to the coating liquid is 0.01–10 g per Kg of the coating liquid. Generally, an amount of 0.02–5 g is preferable. Further, the time when the addition is made is usually just before the coating but addition may be made at any stage during the digestion step, when the compounds of this invention are to be added to a silver halide emulsion.

As the constitution layers of the light-sensitive material to which the compounds of this invention are applied, not only the silver halide photographic emulsion layer but also so-called non-light-sensitive layer such as an inter layer, a protective layer, a subbing layer, a filter layer, an anti-halation layer or a super-coating layer are included and as the silver halide emulsion which can be used, various photographic emulsions such as those for general black and white photography, color photography, X-ray photography, printing, diffusion transfer process of silver dye bleaching process are included. In these emulsions, various silver halides such as silver chloride, silver chlorobromide, silver chloroiodobromide, silver bromide and silver iodobromide and mixture thereof are used.

For the practice of this invention, the most typical silver halide emulsion is in general a gelatin silver halide emulsion and in addition, other silver halide emulsions which are combined with a modified gelatin such as acetylated gelatin or phthalated gelatin, polyvinyl alcohol, or other hydrophilic synthetic- or natural-high molecular compound can be used.

These emulsions may be subjected to a chemical sensitization (the noble metal sensitization, for example, with a gold compound, palladium compound, platinum compound, rhodium compound, iridium compound or active-or inert-selenium compound, the sulfur sensitization, for example, with sodium thiosulfate). Further, as the development accelerator, for example, thioether compounds, quaternary ammonium salts or polyalkylene oxide compounds can be used and, in particular, compounds described in Japanese Patent Publications No. 43-13822 and No. 47-11116 are preferable. The emulsions can be stabilized by using azoles, azaindenes or mercaptans. Further, a wetting agent such as dihydroxy-alkanes, cyclohexanediols, acetylene alcohols or water-dispersible, fine particulate high molecular compounds as obtainable by emulsification polymerization, plasticizing agent or agent for improving physical properties of film can be included. Furthermore, as the hardening agent, there can be used, for example, aldehydes, ethyleneimines, ketones, carboxylic acid derivatives, sufonates, sulfonyl halides or vinyl sulfones. As the hydrophilic colloid layer constituting the non-light-sensitive layer, gelatin is primarily used like as in the silver halide emulsion but other hydrophilic synthetic- or natural-high molecular compounds can also be used. Further, to this non-light-sensitive layer, a wetting agent, plasticizing agent, agent for improving hysical properties of film and hardening agent may be added.

For the practice of this invention, other known surfactants, for example, anionic surfactants such as saponin or sulfosuccinate series, alkyl aryl sulfonate series or compounds, described in Japanese Patent Laid Open Patent Publications No. 49-46733 and No. 51-3219, or amphoteric surfactans may also be used, without causing any inconvenience. Further, to the emulsion, there may be added hydrophilic- or oleophilic-type couplers, various dyes and dye supports, or various photographic additives such as antistatic agent, fluorescent, UV-absorber, anti-stain agent and antioxidant. Furthermore, the emulsion may be spectrally sensitized, if necessary, with a cyanine dye, merocyanine dye, composite cyanine dye or styryl dye.

The present invention will be illustrated by the following Examples but the embodiments of this invention should not be limited thereby.

EXAMPLE 1

A low speed silver chlorobromide photographic positive emulsion, which contains 100 g of gelatin per mol of silver halide (having 20% of silver chloride content) was divided into seven portions and to the four of them, the exemplified compounds (2) and (30) were added in the form of an aqueous solution so that the amount of the above compounds was 2 g and 4 g per Kg of the emulsion, respectively.

To the remaining 2 portions, saponin was added as a comparison compound in the same proportions as the above exemplified compounds, respectively. The remaining last portion was referred to as a blank sample without addition of any compound as above. The seven types of emulsions thus obtained were coated on a baryta paper at the rate of 40 m/minute, to form a positive light-sensitive material.

Coating features and photographic characteristics obtained in each of the above samples after drying are shown in Table 1. Sensitometry was effected according to a standard processing by using D-72 developing solution (having formula according to Eastman Kodak), after exposure with KS-7 type sensitometer (manufactured by Konishiroku Photo Industry).

Table 1

| Compound added | Amount added (g/kg of emulsion) | Coating features: Number of repellencies (number/10m²) | Coating features: Number of comets (number/10m²) | Photographic characteristics: Relative sensitivity | Photographic characteristics: Fog |
|---|---|---|---|---|---|
| Exemplified compound | 2.0 | 1 | 0 | 100 | 0.04 |
| (2) | 4.0 | 0 | 0 | 101 | 0.04 |
| Exemplified compound | 2.0 | 1 | 1 | 100 | 0.04 |
| (30) | 4.0 | 0 | 0 | 100 | 0.04 |
| Saponin | 2.0 | 5 | 6 | 101 | 0.04 |
| | 4.0 | 3 | 2 | 100 | 0.04 |
| — | — | 37 | 21 | 100 | 0.04 |

As evident from Table 1, it is noted that the light-sensitive materials according to this invention show excellent coating features particularly reduced in undesirable defects such as repellecies or comets and no adverse effect is caused on the photographic characteristics.

EXAMPLE 2

A high speed silver iodobromide emulsion for X-ray, which contains 60 g of gelatin per mol of silver halide (having 2 mol% of silver iodide content) was prepared. The emulsion was divided into five portions and to the four of them were added the exemplified compounds (6), (9), (13) and (26), respectively, so that the amount of the exemplified compounds were 2 g per Kg of the emulsion. The resulting emulsions were coated on a subbed polyester film at the rate of 25 m/min. and, after cooling and setting, a 3% gelatin solution containing the above exemplified compounds corresponding to those in the emulsion layers, respectively, in 1 g or 2 g per Kg of the coating liquid was superposed at the similar rate as a protective layer.

To the remaining one portion, none of the above compounds were added and a protective layer to which no such compounds were added was superposed to give a blank sample.

Results on the coating features as obtained in each of the coated samples after drying are shown in Table 2.

Table 2

| Compound added | Amount added to emulsion layer (g/Kg of emulsion) | Amount added to protective layer (g/Kg of 3% gelatin) | Coating features: Number of repellencies (number/10m²) | Coating features: Number of comets (number/10m²) | Photographic characteristics: Relative sensitivity | Photographic characteristics: Fog |
|---|---|---|---|---|---|---|
| Exemplified | 2 | 1 | 0 | 0 | 100 | 0.04 |
| compound (6) | 2 | 2 | 0 | 0 | 101 | 0.04 |
| Exemplified | 2 | 1 | 0 | 1 | 100 | 0.04 |
| compound (9) | 2 | 2 | 0 | 0 | 100 | 0.04 |
| Exemplified | 2 | 1 | 1 | 0 | 100 | 0.04 |
| compound (13) | 2 | 2 | 0 | 0 | 101 | 0.04 |
| Exemplified | 2 | 1 | 0 | 0 | 100 | 0.04 |
| compound (26) | 2 | 2 | 0 | 0 | 100 | 0.04 |
| — | — | — | caused on whole surface | caused on whole surface | 100 | 0.04 |

As evident from Table 2, it is noted that in the samples which contain compounds according to this invention, undesirable defects such as repellencies or comets which are caused at the superposing stage are almost inhibited.

EXAMPLE 3

A silver iodobromide emulsion containing 5 mol% of silver iodide which had been subjected to the second digestion (content of gelatin being 70 g per mol of silver halide) was prepared according to an ordinary process. Thereafter, 2 g of saponin were added per Kg of emulsion. Together with this emulsion, a protective film solution to which a compound of this invention as defined in Table 3 was added in an amount as defined per Kg of 3% gelatin solution was superposed at the same time according to slide-hopper process. Separately from this, a gelatin solution to which a compound structurally analogous to the compounds of this invention as shown below was similarly added as a comparative compound was prepared and coated according to the simultaneous superposing process.

$F_3C(CF_2)_2COO(CH_2CH_2O)_7CH_3$ (Comparative compound B)

$F_3C(CF_2)_7SO_2N(C_2H_5)(CH_2CH_2O)_{14}H$ (Comparative compound C)

(Both compounds are described in French Pat. No. 2,025,688.)

With regard to each of the above coated samples, coating features after drying were examined and also a contact angle to the development solution was measured. Results are shown in Table 3. Measurement of the contact angle was effected by setting a sample horizontally, adding the development solution (D-72) dropwise on the surface of the sample and measuring the contact angle by means of the contact angle measuring device (manufactured by Erma Optical Co., Ltd.). Contact angle means that the smaller the value, the better the wettability or expansibility of the development solution at the development of a film as well as the less the formation of development unevenness or foam on the film surface.

Table 3

| Compound added | Amount Added to protective layer (g/kg of 3% gelatin) | Coating features: Number of repellencies (number/10m²) | Coating features: number of comets (number/10m²) | Contact angle (°) |
|---|---|---|---|---|
| Exemplified | 1 | 0 | 0 | 38 |
| compound (3) | 2 | 0 | 0 | 32 |
| Exemplified | 1 | 0 | 0 | 34 |
| compound (28) | 2 | 0 | 0 | 31 |
| Comparative | 1 | 4 | 2 | 49 |
| compound (B) | 2 | 2 | 1 | 40 |
| comparative | 1 | 3 | 4 | 42 |

Table 3-continued

| Compound added | Amount Added to protective layer (g/kg of 3% gelatin) | Coating features: Number of repellencies (number/10m²) | Coating features: number of comets (number/10m²) | Contact angle (°) |
|---|---|---|---|---|
| compound (C) | 2 | 2 | 3 | 39 |

As evident from Table 3, the samples according to this invention, where the exemplified compounds (3) and (28) were added to the protective layer, respectively, enable excellent even coating without causing any coating defects such as repellencies or coments even under the simultaneous superposing condition of the gelatin-containing colloid solution. Further, it is noted that the samples according to this invention exhibit a less contact angle than the comparative samples and thus are more convenient because less defects are caused during the development.

EXAMPLE 4

A similar high speed silver iodobromide emulsion for X-ray as that of example 2 was prepared. To this emulsion, saponin was added as the coating aid in the amount of 0.5 g per Kg of the emulsion and the emulsion was coated on a subbed polyester film, which was then cooled and set. On the surface of the film, a solution of 2 g of the exemplified compound (12) in 1 liter of 2.5% gelatin solution was immediately coated without drying as the protective layer. After cooling and setting, the film was dried to prepare a sample film. The coating state at this stage was very good and even coating film was obtained.

The film thus obtained and a fluorescent sensitizing paper for X-ray (having 425 nm of fluorescent maximum wavelength) were superposed intimately and a constant abrasion was applied by means of a roller from the sensitizing paper side under the condition of 30% of humidity. Then, the film was taken out and subjected to ordinary development processing to examine formation of a static mark. There was observed, however, no formation of static mark.

When a film wherein a protective layer to which, in place of the exemplified compound (12), 2 g of a comparative compound having a similar structure to the compounds of this invention were added in the similar manner was applied, was prepared and examined in the same manner as above, there was observed outstanding formation of static mark.

Comparative compound (D)

$$F_3C-(CF_2)_7SO_2N(C_2H_5)-(CH_2CH_2O)_{14}H$$

(This compound is described in French Pat. No. 2,025,688.)

EXAMPLE 5

As a cyan coupler, 20 g of 2-(α-di-tertiary amyl phenoxy-n-butylamino)-4,6-dichloro-5-methylphenol were weighed, and 10 ml of tricresyl phosphate and 30 ml of ethyl acetate were added thereto. After dissolution, the resulting solution was emulsified and dispersed in 300 ml of 5% gelatin solution containing saponin. The resulting emulsion was further emulsified and dispersed thoroughly by means of a homogenizer and thereafter added to 1 liter of a silver chlorobromide emulsion for use in color photographic printing paper (silver halide content: 0.35 mol) to make up the total amount to 5 liter to prepare an emulsion for use in color photographic paper. The emulsion was divided into four portions. Further, the compounds of this invention and the comparative compound (E) having the analogous structure to those of the compounds of this invention as defined in Table 5 were added. The emulsion thus obtained was coated and dried on a baryta paper so that the thickness of the dried film was 3μ. The samples thus prepared were subjected, after web exposure, to ordinary color development, termination, bleaching, fixing, washing with water and drying to give a cyan dye image. By the heat test and the anti-humidity test on such samples, stability of dye image was examined.

Comparative compound (E)

$$NaO_3S-CH(CH_2-COOCH_2(CF_2CF_2)_2H)-COOCH_2(CF_2CF_2)_2H$$

(This compound is described in Japanese Patent L-O-P Publication No. 49-46733.)

Results obtained are shown in Table 5, in which numerals mean the percentage (%) of a ratio of the concentration (D) after the examination at the same position to the dye image concentration before said heat test and anti-humidity test, referred to as 1.0. Thus, it is noted that the greater of the value, the better of the stability.

Table 5

| Compound added and its amount (0.2g/g of coupler) | Concentration ratio of dye image in heat test and anti-humidity test: Storage at 55° C., 30% RH (7 days) | Storage at 70° C., 80% RH (4 days) |
|---|---|---|
| Exemplified compound (1) | 94 | 98 |
| Exemplified compound (17) | 96 | 94 |
| Comparative compound (E) | 72 | 81 |
| (Blank) | 72 | 81 |

(RH means relative humidity.)

From the above Table 5, it is noted that the addition of the compounds of this invention results in particular increase in the heat resistance and the humidity resistance of the cyan dye image obtainable from the cyan coupler. Further, similar results as those in the above cyan coupler were obtained even when a magenta coupler or yellow coupler was used in place of the cyan coupler. Furthermore, from the above Example, it was noted that also in a light-sensitive material containing an oleophilic coupler for color photography, a sample which contained a compound of this invention exhibits excellent coating properties, causing no unevenness or repelling.

What we claim is:

1. A process for the preparation of a photographic element comprising a support and a photographic layer thereon, said photographic layer containing a silver halide layer, said process comprising applying to said element a coating solution which contains a compound represented by the following formula (I) or (II):

$$C_{3n}F_{(6n)+1}-Y-A-B \quad (I)$$

$$C_{3n}F_{(6n)-1}-Y-A-X-A-Y-C_{3n}F_{(6n)-1} \quad (II)$$

wherein A represents a simple bond or a divalent group; Y represents oxygen or sulfur, or $$-\underset{\underset{R_1}{|}}{N}-A'-;$$

B represents a monovalent hydrophilic group; X represents a divalent hydrophilic group; n represents an integer of 1 to 4; $R_1$ represents hydrogen, a lower alkyl group; and A' represents a simple bond or an alkylene group.

2. A process according to claim 1 wherein A represents a simple bond, an alkylene group, a phenylene group, an aralkylene group, or alkarylene group, or $$\left(CH_2-\underset{\underset{R_2}{|}}{CH}\right)_{n_1}-A'-,\quad -C_6H_4-SO_2-\underset{\underset{R_2}{|}}{N}-A'-,$$

$$-C_6H_4-CO-\underset{\underset{R_2}{|}}{N}-A'- \text{ or}$$

$$-C_6H_4-CO-\underset{\underset{R_2}{|}}{N}-A''-O-$$

wherein $R_2$ has the same meaning as $R_1$; A' represents a simple bond or an alkylene group; A'' represents an alkylene group; and $n_1$ represents an integer of 1 to 30.

3. A process according to claim 1 wherein B represents $$-OH,\ -SO_3M,\ -COOM,\ -PO\,.\,(OM)_2,\ \left(CH_2\underset{\underset{R_3}{|}}{CH}-O\right)_{n_2}-R_3,$$

$$\left(CH_2-\underset{\underset{OH}{|}}{CH}CH_2-O\right)_{n_2}-H,\ -\overset{\overset{R_4}{|}}{\underset{\underset{R_6}{|}}{\oplus N}}-R_5\,.\,X_1\ominus,\ -\overset{\overset{R_7}{|}}{\underset{\underset{(CH_2)_{n_3}COO\ominus}{|}}{\oplus N}}-R_8 \quad \text{or}$$

$$-\overset{\overset{R_9}{|}}{\underset{\underset{(CH_2)_{n_4}SO_3\ominus}{|}}{\oplus N}}-R_{10}$$

wherein $R_3$ has the same meaning as $R_1$; $n_2$ has the same meaning as $n_1$; M represents hydrogen, alkali metal or substituted or unsubstituted ammonium; $R_4$, $R_5$, $R_6$, $R_7$, $R_8$, $R_9$ and $R_{10}$ individually represent an alkyl group or an aralkyl group; $n_3$ represents an integer of 1 or 2; $n_4$ represents an integer of 2 to 4; and $X_1\ominus$ represents an anion, and further $R_4$, $R_5$ and/or $R_6$, $R_7$ and $R_8$, or $R_9$ and $R_{10}$ may be cyclized to form together a 5- or 6-membered heterocyclic ring containing nitrogen.

4. A process according to claim 1 wherein X represents $$\begin{matrix} POOM, & -O\,.\,\underset{\underset{-O\,.\,COCH_2}{|}}{COCH}-SO_3M_1 \end{matrix} \quad \text{or}$$

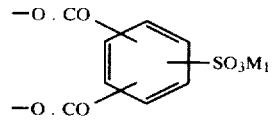

(wherein $M_1$ has the same meaning as M.)

5. A process according to claim 3 wherein $X_1\ominus$ represents a halogen ion, an alkyl sulfonate ion, an arylsulfonate ion, a nitrate ion, a sulfonate ion, a sulfate ion or a phosphate ion.

6. A process according to claim 3 wherein the 5- or 6-membered heterocyclic ring containing nitrogen is selected from the group consisting of a pyridine ring, a pyrimidine ring, a pyridazine ring, an imidazol ring, a piperazine ring, a morpholin ring and a piperidine ring.

7. A process according to claim 4 wherein X represents $$\begin{matrix} POOM_1, & -O\,.\,\underset{\underset{-O\,.\,COCH_2}{|}}{COCH}-SO_3M_1 \end{matrix} \quad \text{or}$$

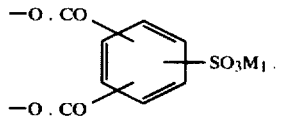

8. A process according to claim 1 wherein the compound is selected from the group consisting of examplified compound (1), (2), (3), (4), (5), (6), (7), (8), (9), (10), (11), (12), (13), (14), (15), (16), (17), (18), (19), (20), (21), (22), (23), (24), (25), (26), (27), (28), (29), (30) and (31).

9. A silver halide photographic material produced by the process according to claim 1.

10. A process according to claim 1 wherein said coating solution is incorporated in said silver halide layer, an interlayer, a protective layer, a subbing layer, a filter layer, an antihalation layer, or a supercoating layer.

11. A process according to claim 10 wherein said coating solution is incorporated in said silver halide emulsion layer or said protective layer.

12. A process according to claim 11 wherein said coating solution is incorporated in said silver halide emulsion layer which also contains a coupler.

* * * * *